US008770575B2

(12) United States Patent
Yuasa

(10) Patent No.: US 8,770,575 B2
(45) Date of Patent: Jul. 8, 2014

(54) SHEET SUPPLY DEVICE AND IMAGE FORMING APPARATUS

(75) Inventor: Hiroshi Yuasa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 483 days.

(21) Appl. No.: 12/232,143

(22) Filed: Sep. 11, 2008

(65) Prior Publication Data

US 2009/0079125 A1 Mar. 26, 2009

(30) Foreign Application Priority Data

Sep. 26, 2007 (JP) ..... 2007-248442

(51) Int. Cl.
*B65H 3/52* (2006.01)

(52) U.S. Cl.
USPC ..... 271/125; 271/121; 271/122

(58) Field of Classification Search
USPC ..... 271/121, 122, 125
See application file for complete search history.

(56) References Cited

U.S. PATENT DOCUMENTS

| | | | | | |
|---|---|---|---|---|---|
| 4,360,263 | A * | 11/1982 | Miyoshi et al. | 355/29 |
| 4,852,868 | A * | 8/1989 | Fukui et al. | 271/122 |
| 4,928,951 | A * | 5/1990 | Fukui | 271/113 |
| 5,029,840 | A * | 7/1991 | Haga et al. | 271/122 |
| 5,350,168 | A * | 9/1994 | Sheridan | 271/122 |
| 6,129,347 | A * | 10/2000 | Brooks et al. | 271/22 |
| 6,367,795 | B1 * | 4/2002 | Matsuda et al. | 271/126 |
| 7,607,655 | B2 * | 10/2009 | Oomori et al. | 271/117 |
| 7,669,844 | B2 * | 3/2010 | Ohgita et al. | 271/9.01 |
| 7,798,483 | B2 * | 9/2010 | Oomori | 271/118 |
| 7,866,658 | B2 * | 1/2011 | Bokelman et al. | 271/117 |
| 2003/0155702 | A1 * | 8/2003 | Togashi et al. | 271/121 |
| 2003/0160381 | A1 * | 8/2003 | Sonoda et al. | 271/121 |

FOREIGN PATENT DOCUMENTS

| | | | |
|---|---|---|---|
| JP | 2002226073 | A * | 8/2002 |
| JP | 2006-248689 | | 9/2006 |

* cited by examiner

*Primary Examiner* — Ernesto Suarez
(74) *Attorney, Agent, or Firm* — Kubotera & Associates, LLC

(57) ABSTRACT

A sheet supply device includes a first separation unit for applying a transportation load to a medium supplied from a stored state with a sheet supply member to separate the medium, and a second separation unit disposed on a downstream side of the first separation unit for separating the medium passing through the first separation unit. The first separation unit is disposed outside an extension area of the second separation unit in a medium transportation direction.

18 Claims, 7 Drawing Sheets

SHEET SUPPLY DEVICE AND IMAGE FORMING APPARATUS

BACKGROUND OF THE INVENTION AND RELATED ART STATEMENT

The present invention relates to a sheet supply device for supplying a sheet and an image forming apparatus having the sheet supply device.

In a conventional image forming apparatus such as a printer, a copier, a facsimile, and the likes, a sheet supply device is provided for supplying a sheet to an image forming unit for forming an image on the sheet.

When the sheet supply device is a retard separation type as a sheet separation type, a separation supply unit is disposed on a sheet pick up side of a medium tray storing a medium for separating and supplying the medium one by one. The separation supply unit includes a retard separation unit for separating the medium thus picked up. The retard separation unit includes a sheet supply roller to be pressed against the medium for picking up the medium; a transportation roller; and a separation roller abutting against the transportation roller.

The separation roller of the retard separation unit generates torque in a direction of returning the medium backward. When only one medium is supplied, the separation roller follows and rotates in a sheet supply direction through friction between the medium and the separation roller. When more than two media are supplied, the separation roller generates a medium separation function and applies brake to the media with the torque, thereby supplying only one medium.

In Patent Reference, a double supply regulating unit (a primary separation unit) is separately disposed between a sheet supply roller and a retard separation unit (a secondary separation unit). The double supply regulating unit (the primary separation unit) separates a leading edge of a medium picked up with the sheet supply roller. The retard separation unit (the secondary separation unit) includes a guide member for guiding the medium, and has a function of preventing a plurality of media from being supplied to the retard separation unit.

Patent Reference: Japan Patent Publication No. 2006-248689

In an electro-photography printer as an image forming apparatus, there has been a demand for reducing energy consumption and a space, thereby making it necessary to reduce a size of the electro-photography printer. On the other hand, it is necessary to print on various types of media according to various applications. Accordingly, it is necessary to improve a function capable of transporting various types of media.

In particular, in an electro-photography printer capable of printing a color image, it is necessary to print on a medium having a large thickness. When the sheet supply device disclosed in Patent Reference supplies a medium having a large thickness, however, the primary separation unit may be excessively deformed due to stiffness of the medium, so that the primary separation unit thus deformed interferes with the secondary separation unit disposed on a downstream side in a medium transportation direction.

To this end, rigidity of the primary separation unit may be increased. Alternatively, the primary separation unit may be disposed sway from the secondary separation unit, so that the primary separation unit can stably separate the medium without interfering with the secondary separation unit even when the primary separation unit is deformed. However, when the primary separation unit is disposed sway from the secondary separation unit, it is necessary to increase a size of the image forming apparatus.

In view of the problems described above, an object of the present invention is to provide a sheet supply device and an image forming apparatus capable of solving the problems. In the invention, it is possible to stably separate a medium without interfering with a secondary separation unit even when a primary separation unit is excessively deformed due to stiffness of the medium.

Further objects of the invention will be apparent from the following description of the invention.

SUMMARY OF THE INVENTION

According to the present invention, a sheet supply device includes a first separation unit for applying a transportation load to a medium supplied from a stored state with a sheet supply member to separate the medium, and a second separation unit disposed on a downstream side of the first separation unit for separating the medium passing through the first separation unit. The first separation unit is disposed outside an extension area of the second separation unit in a medium transportation direction.

In the present invention, the first separation unit is disposed outside the extension area of the second separation unit in the medium transportation direction. That is, the first separation unit is disposed at a position not overlapping with the second separation unit with respect to the medium transportation direction. Accordingly, even when the first separation unit is deformed due to stiffness of the medium, it is possible to properly separate the medium without interfering with the second separation unit and increasing a size of an image forming apparatus.

DETAILED DESCRIPTION OF THE PREFERRED EMBODIMENTS

Hereunder, embodiments of the present invention will be described in detail with reference to the accompanying drawings. In the following description, an electro-photography printer will be explained as an image forming apparatus.

First Embodiment

Figure 1:
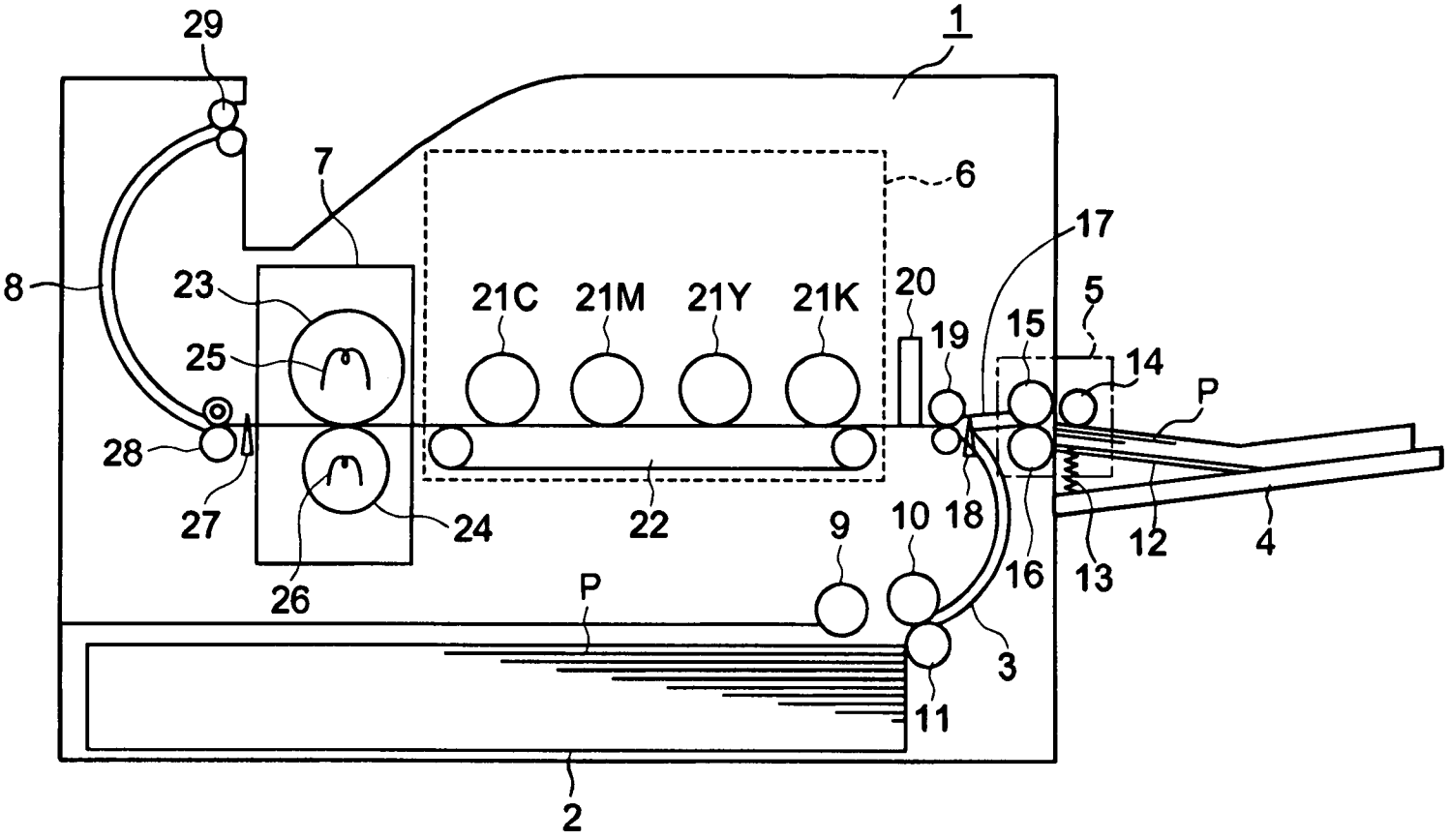
FIG. 1 is a schematic view showing an electro-photography printer according to a first embodiment of the present invention.

A first embodiment of the present invention will be explained. FIG. 1 is a schematic view showing an electro-photography printer 1 according to the first embodiment of the present invention.

As shown in FIG. 1, the electro-photography printer 1 as an image forming apparatus includes a medium cassette 2, a sheet supply transportation path 3, a medium tray 4, a sheet supply unit 5, an image forming unit 6, a fixing unit 7, and a discharge transportation path 8. A medium P is stored in the medium cassette 2, and a pressing member (not shown) presses the medium P against a pickup roller 9. A transportation roller 10 and a separation roller 11 are disposed on a right side (refer to FIG. 1) of the pickup roller 9 for separating the medium P picked up with the pickup roller 9 and for transporting the medium P into the sheet supply transportation path 3.

In the embodiment, the medium tray 4 is provided for supplying a long medium, a thin medium, a thick medium, or a narrow medium, that the medium cassette 2 cannot handle. The medium cassette 4 is attached to the electro-photography printer 1 in a foldable manner. A pressing spring 13 is disposed below a distal end portion of a placing plate 12.

In the embodiment, the sheet supply unit 5 constitutes a sheet supply device for supplying the medium P placed on the medium tray 4 to the image forming unit 6. The sheet supply unit 5 includes a sheet supply roller 14, a transportation roller 15, and a separation roller 16. A configuration of the sheet supply unit 5 will be explained later in more detail.

In the embodiment, a transportation path 17 is connected to the sheet supply unit 5 and extends to the image forming unit 6. A sheet supply sensor 18, a print timing adjusting member 19, and a writing timing sensor 20 are disposed along the transportation path 17. The print timing adjusting member 19 is formed of a pair of rollers.

In the embodiment, the image forming unit 6 includes photosensitive drums 21K, 21Y, 21M, and 21C for forming toner images in black, yellow, magenta, and cyan, respectively, on the medium P to form a color image thereon. Further, the image forming unit 6 includes a transfer belt unit 22 and the likes for forming an image on the medium P through an electro-photography process. The medium P is synchronized to an image forming operation of the image forming unit 6 with the print timing adjusting member 19, so that an image is formed on one side of the medium P. Afterward, the medium P is transported to the fixing unit 7 disposed on a downstream side of the image forming unit 6.

In the embodiment, the fixing unit 7 includes a pair of rollers 23 and 24 pressed against with each other with a specific pressure. Heaters 25 and 26 are disposed inside the rollers 23 and 24 for heating, respectively. A transportation path 8 is connected to the fixing unit 7. A transportation detection sensor 27, a pair of transportation rollers 28, and a pair of discharge rollers 29 are disposed along the transportation path 8. The transportation rollers 28 and the discharge rollers 29 transport and discharge the medium P outside the electro-photography printer 1 through the transportation path 8 after fixing.

Figure 2:
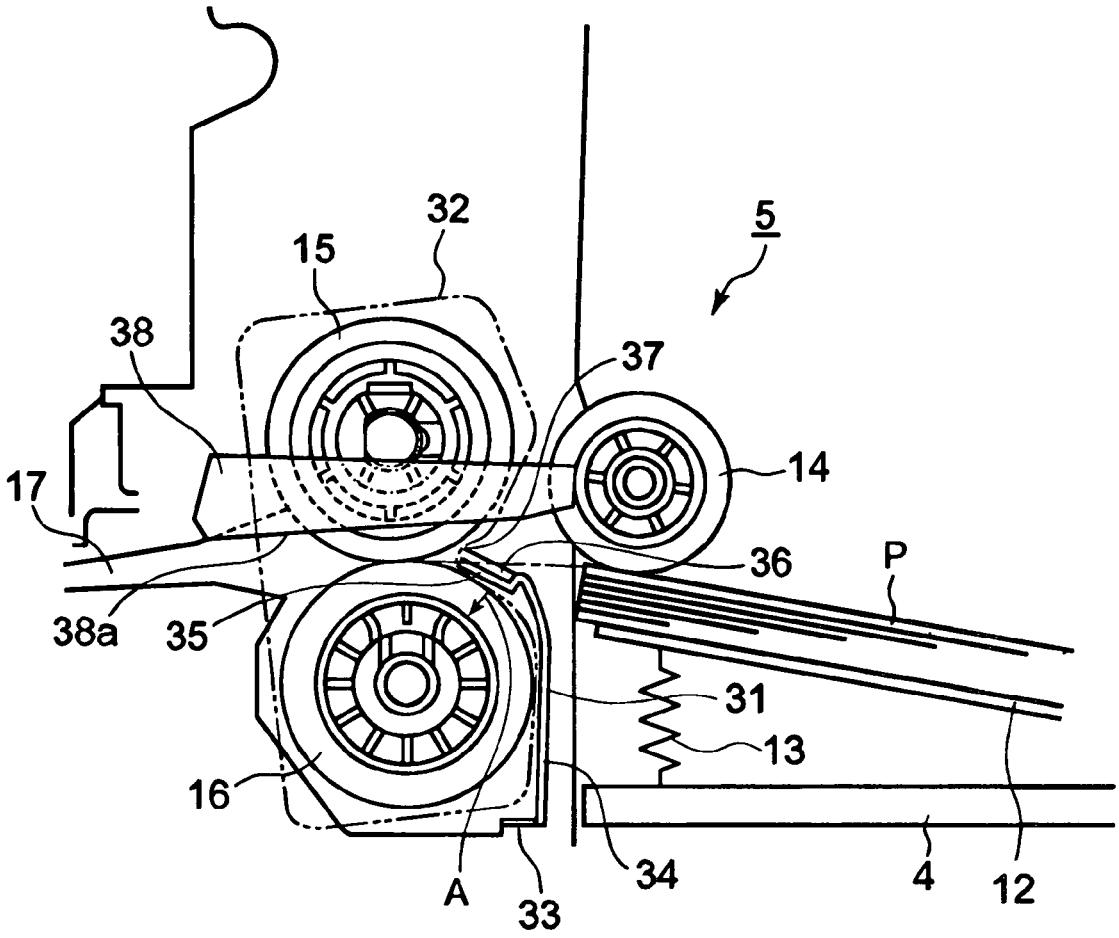
FIG. 2 is a schematic side view showing a sheet supply device according to the first embodiment of the present invention.

FIG. 2 is a schematic side view showing the sheet supply unit 5 according to the first embodiment of the present invention. As shown in FIG. 2, the sheet supply unit 5 includes the sheet supply roller 14 driven with a drive system (not shown) for supplying the medium P placed on the placing plate 12 and pressed with the pressing spring 13. Further, the sheet supply unit 5 includes a second separation unit 32 (a second separation portion indicated with a hidden line) formed of a pair of the transportation roller 15 and the separation roller 16 pressed against with each other with a specific pressure. First separation units 31 are disposed between the sheet supply roller 14 and the second separation unit 32 in the medium transportation direction for separating a leading edge of the medium P and guiding the medium P to the second separation unit 32.

In the embodiment, each of the first separation units 31 is formed of a thin metal plate (a stainless steel plate with a thickness of 0.2 mm) having a fixed portion 33 fixed to a main frame of the electro-photography printer 1; a vertical portion 34 extending vertically from the fixed portion 33; and an inclined portion 35 extending obliquely and upwardly from the vertical portion 34 in the medium transportation direction. A friction member 36 is attached to a surface of the inclined portion 35.

In the embodiment, the friction member 36 is disposed at a position abutting against the leading edge of the medium P, so that the friction member 36 applies a transportation load to the medium P thus supplied to separate the leading edge of the medium P and guide the medium P toward a downstream side in the transportation direction. The friction member 36 is formed of a rubber piece made of, for example, EPDM (Ethylene-Propylene Diene Monomer).

As shown in FIG. 2, the friction member 36 has a top portion 37 at a highest position in each of the first separation units 31. It is configured such that the top portion 37 is situated above (2.1 mm above in the embodiment) a line (indicated with a projected line) between a contact point between the sheet supply roller 14 and the medium P and a contact point between the transportation roller 15 and the separation roller 16.

In the embodiment, a plurality of transportation guides 38 is disposed above the first separation units 31, so that the transportation guides 38 and the first separation units 31 form the transportation path 17 of the medium P. The transportation guides 38 are formed of a resin or a plastic in a rib shape, and have bottom portions 38*a* arranged such that a vertical space of the transportation path 17 gradually decreases from a point near the sheet supply roller 14 toward a downstream side of the second separation unit 32.

Figure 3:
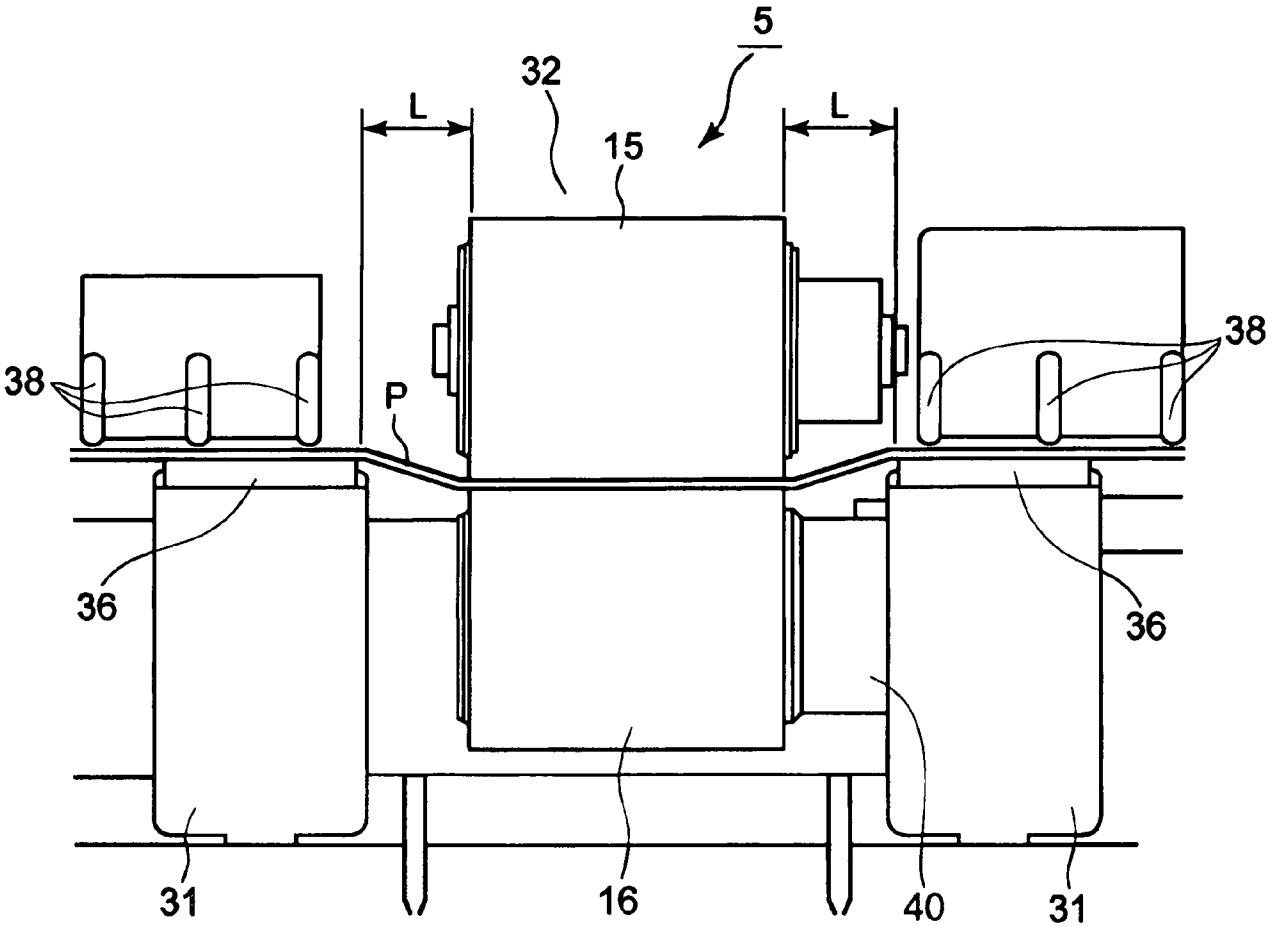
FIG. 3 is a schematic front view showing the sheet supply device according to the first embodiment of the present invention.

FIG. 3 is a schematic front view showing the sheet supply device according to the first embodiment of the present invention. In FIG. 3, the sheet supply roller 14 is omitted, and the sheet supply unit 5 is viewed from a side of the medium tray 4.

As shown in FIG. 3, the first separation units 31 with the friction members 36 are disposed on both sides of the transportation roller 15 and the separation roller 16 constituting the second separation unit 32 away from each other by a distance L. That is, the first separation units 31 and the second separation unit 32 are arranged not to overlap with each other in the transportation direction of the medium P.

In the embodiment, the top portions 37 of the first separation units 31 contact with the medium P at positions different from that of the second separation unit 32 in a vertical direction, thereby causing the medium P to bend or sag. The distance L is determined according to a sagging shape of the medium P in a direction perpendicular to the transportation direction.

When the distance L is small, the sagging shape of the medium P is bent by a large angle between the first separation units 31 and the second separation unit 32. Accordingly, when the medium P has high stiffness, an excessive force is applied to the separation roller 16 downwardly, so that it is difficult to efficiently separate the medium P with the second separation unit 32.

When the distance L increases, on the other hand, it is necessary to arrange the first separation units 31 within a transportation range (in a width direction) of the medium P having a minimum size that the sheet supply unit 5 can handle. In the embodiment, the distance L is set 10 mm. Note that the sheet supply roller 14 is disposed within a width range substantially the same as that of the transportation roller 15 and the separation roller 16 in a direction (a lateral direction in FIG. 3) perpendicular to the transportation direction.

In the embodiment, a drive system (not shown) drives the transportation roller 15 of the second separation unit 32. The separation roller 16 is provided with a torque limiter 40 for generating a brake force to be applied to the medium P. The torque limiter 40 is disposed to be freely rotatable and not rotate spontaneously. A supporting shaft fixed in a rotational direction supports the torque limiter 40.

An operation of the electro-photography printer 1 will be explained next. First, an operation of forming an image on the medium P will be explained. As shown in FIG. 1, the pressing spring 13 presses the medium P placed on the medium tray 4 against the sheet supply roller 14. When a drive system (not shown) drives the sheet supply roller 14 to rotate in a clockwise direction, the medium P is transported. When a plurality of media P is transported, the first separation units 31 and the second separation unit 32 of the sheet supply unit 5 transport only the medium P at an uppermost position toward a downstream side to the image forming unit 6. An operation of the sheet supply unit 5 will be explained in more detain later.

When the sheet supply sensor 18 detects the medium P supplied from the sheet supply unit 5, the print timing adjusting member 19 synchronizes the medium P with an image forming process (not shown) of the image forming unit 6. Further, the writing timing sensor 20 detects the leading edge of the medium P, and the medium P is transported to the image forming unit 6.

In the image forming unit 6, the toner images in each color are formed on the photosensitive drum 21K, 21Y, 21M, and 21C. The toner images are then transferred to the medium P transported with the transfer belt unit 22. After the toner image in cyan is transferred, the medium P is sent to the fixing unit 7.

In the fixing unit 7, the heaters 25 and 26 heat the rollers 23 and 24, so that the toner images are fixed to the medium P through heat and pressure. After the toner images are fixed to the medium P in the fixing unit 7, the transportation detection sensor 27 detects the medium P passing therethrough. The transportation rollers 28 transport the medium P through the discharge transportation path 8, and the discharge rollers 29 discharge the medium P outside the electro-photography printer 1, thereby completing the printing operation.

An operation of the sheet supply unit 5 will be explained next. As shown in FIG. 2, the sheet supply roller 14 picks up the medium P placed on the medium tray 4. After the sheet supply roller 14 picks up the medium P, the medium P is transported to the transportation path 17 between the first separation units 31 and the transportation guides 38, and abuts against the friction members 36 of the first separation units 31. Accordingly, when a plurality of the media P is transported, the leading edges of the media P are separated along inclined surfaces of the friction members 36 through a frictional force of the friction members 36 and the inclined surfaces.

As described above, the first separation units 31 are disposed outside the second separation unit 32. Further, the top portions 37 of the first separation units 31 are situated above the contact point between the transportation roller 15 and the separation roller 16 of the second separation unit 32 in the vertical direction. Accordingly, the medium P bends or sags both in the transportation direction thereof and the direction (the width direction of the medium P) perpendicular to the transportation direction. In FIG. 3, the medium P sags in a width direction thereof.

In the embodiment, when a plurality of the media P is transported, a space is created between the media P due to the sagging thereof. Accordingly, it is possible to reduce a frictional force between the media P. That is, a plurality of the media P is transported to the second separation unit 32 with the space therebetween. Accordingly, it is possible to securely separate the media P with the second separation unit 32.

In the embodiment, a medium transportation force Ff is generated through a drive force of the transportation roller 15 and a frictional force μr between the medium P and the transportation roller 15. When only a single medium P is transported to the second separation unit 32, the medium transportation force Ff becomes smaller than a brake force Ft of the separation roller 16 generated with the torque limiter 40 for stopping the medium P (Ff>Ft). Accordingly, the torque limiter 40 and the separation roller 16 follow the medium P and rotate in the transportation direction, thereby transporting the medium P to the sheet supply sensor 18 on the downstream side.

When two media, i.e., a medium P1 and a medium P2, are transported to the second separation unit 32, the medium transportation force Ff is generated through the drive force of the transportation roller 15 and a frictional force μr between the medium P1 abutting against the transportation roller 15 and the transportation roller 15. Further, the torque limiter 40 generates the brake force Ft of the separation roller 16 for stopping the medium P2 abutting against the separation roller 16.

In this case, the medium transportation force Ff and the brake force Ft are sufficiently larger than a frictional force Fpp between the medium P1 abutting against the transportation roller 15 and the medium P2 abutting against the separation roller 16 (Ff, Ft>>F μp). Accordingly, only the medium P1 abutting against the transportation roller 15 is transported to the sheet supply sensor 18 on the downstream side, and the medium P2 abutting against the separation roller 16 is not transported.

In the embodiment, when the sheet supply roller 14 transports the medium P and the leading edge of the medium P abuts against the friction members 36 of the first separation units 31, the friction members 36 may sag or bend in an arrow direction A shown in FIG. 2. As shown in FIG. 3, the first separation units 31 do not contact with the second separation unit 32, and are disposed on both sides of the second separation unit 32 outside an extension area of the second separation unit 32 in the medium transportation direction. Accordingly, even when the friction members 36 sag, the friction members 36 do not interfere with the transportation roller 15 or the separation roller 16 of the second separation unit 32.

When the sheet supply sensor 18 (refer to FIG. 1) detects the medium P transported from the second separation unit 32, the print timing adjusting member 19 synchronizes the medium P with an image forming process (not shown) of the image forming unit 6, so that the toner images are transferred to the medium P transported to the image forming unit 6. An operation after the process described above is the same as that described above.

As described above, in the embodiment, the first separation units 31 are disposed outside the extension area of the second separation unit 32 in the medium transportation direction. Accordingly, when the medium P having high stiffness is transported and the first separation units 31 are deformed excessively upon abutting against the medium P, it is possible to prevent the first separation units 31 from interfering with the second separation unit 32. As a result, it is possible to stably separate and supply the medium P without increasing a size of the electro-photography printer 1.

Further, when a plurality of the media P is transported to the first separation units 31, the media P sag in the transportation direction and the perpendicular direction thereof, and a space is created between the media P. Accordingly, it is possible to securely separate the media P with the second separation unit 32.

In the embodiment described above, the friction members 36 of the first separation units 31 are formed of the rubber piece made of EPDM, and are not limited thereto. A material with a high friction coefficient such as a cork price, a felt, and a sponge may be used. Further, the first separation units 31 may not be provided with the friction members 36, and may be provided with an inclined surface instead for applying a transportation load.

In the embodiment described above, the second separation unit 32 is a separate roller type formed of the transportation roller 15 and the separation roller 16. Instead of the separation roller 16, the second separation unit 32 may be a separation pad type using a separation pad, or any other separation types using a frictional separation method.

Second Embodiment

Figure 4:
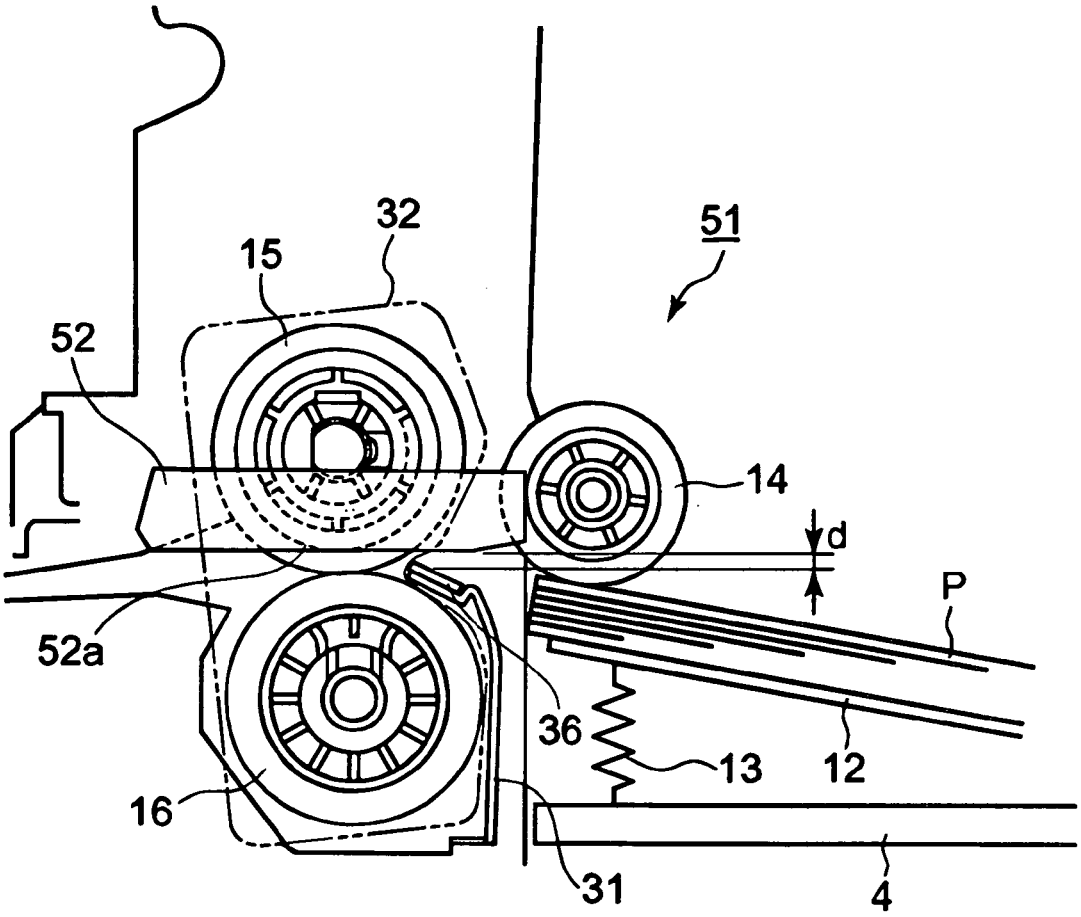
FIG. 4 is a schematic front view showing a sheet supply device according to a second embodiment of the present invention.

A second embodiment of the present invention will be explained next. FIG. 4 is a schematic front view showing a sheet supply device or a sheet supply unit 51 according to the second embodiment of the present invention.

As shown in FIG. 4, similar to the first embodiment, the sheet supply unit 51 includes the sheet supply roller 14, the first separation units 31, and the second separation unit 32 (indicated with a phantom line). The second separation unit 32 is formed of a pair of the transportation roller 15 and the separation roller 16 pressed against with each other. The first separation units 31 are disposed outside the extension area of the second separation unit 32 in the medium transportation direction.

In the second embodiment, different from the first embodiment, transportation guides 52 are provided above the first separation units 31. The transportation guides 52 have lower portions 52*a* extending in substantially a horizontal direction such that a minimum space d of the transportation path 17 between the first separation units 31 and the transportation guides 52 satisfies the following relationship:

$$t\max < d < 3 \times t\max$$

where tmax is a maximum thickness of the medium P that the sheet supply unit 51 can handle. When the maximum thickness tmax of the medium P is 0.4 mm, the space d is set, for example, 1.0 mm.

As described above, the transportation guides 52 have the lower portions 52*a* extending in substantially the horizontal direction, and the lower portions 52*a* may be slightly inclined as far as the minimum space d of the transportation path 17 between the first separation units 31 and the transportation guides 52 satisfies the above relationship.

Note that the maximum thickness tmax of the medium P may be set according to a maximum thickness of the medium P that the image forming unit 6 can transfer the image thereto or the fixing unit 7 can fix the image thereto. It is preferred to determine the maximum thickness tmax of the medium P according to a maximum thickness of the medium P that the electro-photography printer 1 as a whole can handle.

Figure 5:
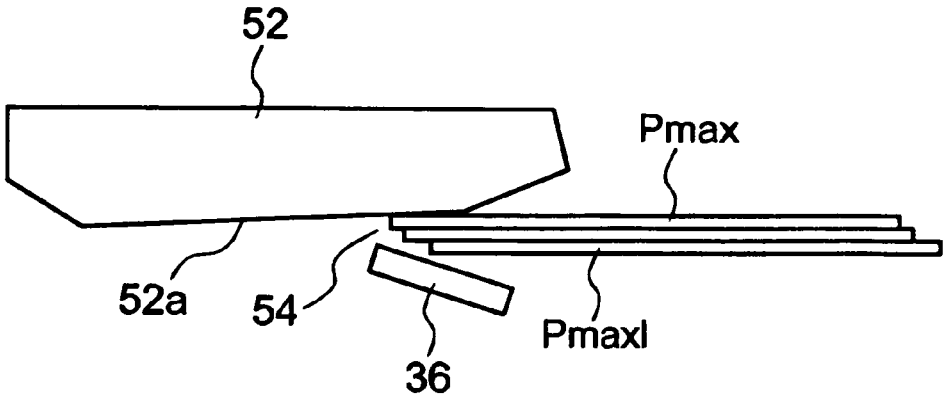
FIGS. 5(*a*) and 5(*b*) are schematic views showing an operation of the sheet supply device according to the second embodiment of the present invention.
Figure 5:
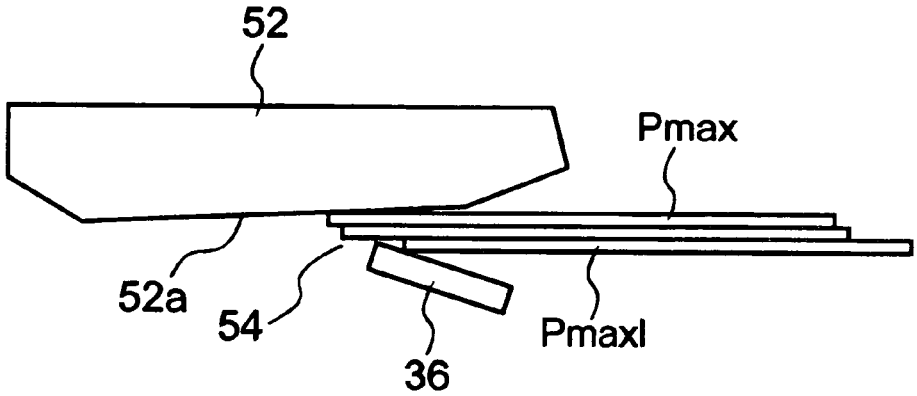

An operation of supplying a medium Pmax having a maximum thickness that the sheet supply unit 51 can handle will be explained next. FIGS. 5(*a*) and 5(*b*) are schematic views showing the operation of the sheet supply device according to the second embodiment of the present invention.

When the sheet supply roller 14 supplies a plurality of media Pmax having the maximum thickness as a media bundle, the transportation guides 52 regulate an upper surface of the media bundle as shown in FIG. 5(*a*).

In the embodiment, the friction members 36 of the first separation units 31 and the transportation guides 52 form a transportation path 54 having a wedge shape. Accordingly, the media Pmax at a lower portion of the media bundle abuts against the inclined surfaces of the friction members 36 and are prevented from proceeding further. As a result, as shown in FIG. 5(*b*), only two media Pmax from the top of the media bundle can pass through the transportation path 54.

In the embodiment, the second separation unit 32 does not drive the separation roller 16, i.e., the sheet supply unit 51 is a so-called semi-retard type. Accordingly, when two media P are supplied to the second separation unit 32, it is possible to efficiently separate the media P.

As described above, in the embodiment, the transportation guides 52 and the first separation units 31 are arranged such that the minimum space d therebetween satisfies the following relationship:

$$t\max < d < 3 \times t\max$$

where tmax is a maximum thickness of the medium P that the sheet supply unit 51 can supply. Accordingly, it is possible to pass one or two media Pmax through between the first separation units 31 and the transportation guides 52, thereby making it possible to efficiently separate the media P with the second separation unit 32.

Third Embodiment

Figure 6:
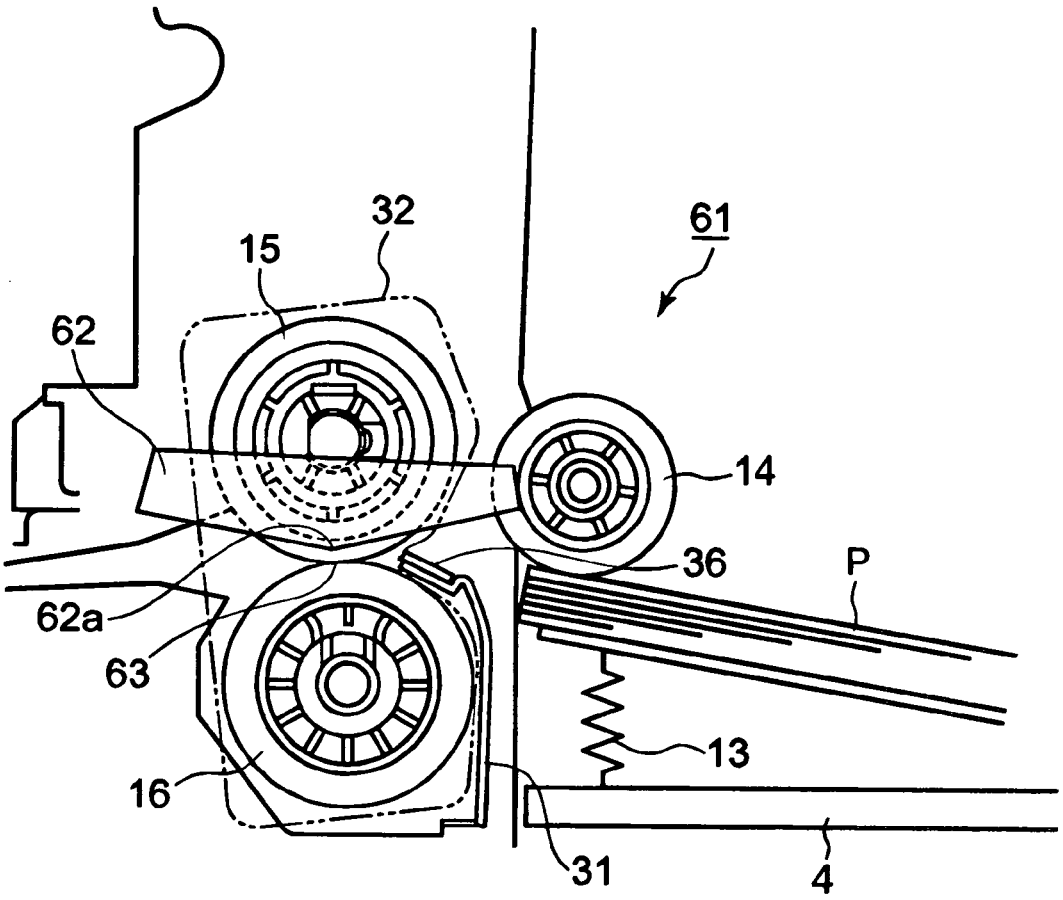
FIG. 6 is a schematic front view showing a sheet supply device according to a third embodiment of the present invention.

A third embodiment of the present invention will be explained next. FIG. 6 is a schematic front view showing a sheet supply device or a sheet supply unit 61 according to the third embodiment of the present invention.

As shown in FIG. 6, similar to the first and second embodiments, the sheet supply unit 61 includes the sheet supply roller 14, the first separation units 31, and the second separation unit 32 (indicated with a phantom line). The second separation unit 32 is formed of a pair of the transportation roller 15 and the separation roller 16 pressed against with each other. The first separation units 31 are disposed outside the extension area of the second separation unit 32 in the medium transportation direction.

In the third embodiment, different from the second embodiment, transportation guides 62 are provided above the first separation units 31. The transportation guides 62 have lower portions for guiding the leading edge of the medium P toward a nip portion 62 between the transportation roller 15 and the separation roller 16, i.e., the transportation guides 62 have lower portions having an inclined shape inclined toward the nip portion 62.

In the embodiment, the transportation guides 62 have lower top portions 62*a* situated above the nip portion 63 between the transportation roller 15 and the separation roller 16. More specifically, the lower top portions 62*a* situated above the nip portion 63 by 0.5 mm.

In the embodiment, when the sheet supply roller 14 supplies the medium P, the friction members 36 of the first separation units 31 separate the leading edge of the medium P. Then, the transportation guides 62 guide the medium P toward the nip portion 63 between the transportation roller 15 and the separation roller 16 of the second separation unit 32

(toward a position lower than the upper most position of the first separation units 31). Accordingly, it is possible to easily bend the medium P on the downstream side of the first separation units 31, thereby transporting the medium P the second separation unit 32 smoothly.

As described above, in the embodiment, the transportation guides 62 are provided for guiding the leading edge of the medium P toward the nip portion 62 of the second separation unit 32. Accordingly, it is possible to easily bend the medium P on the downstream side of the first separation units 31, thereby reducing friction between the media P upon transporting a plurality of the media P.

Fourth Embodiment

Figure 7:
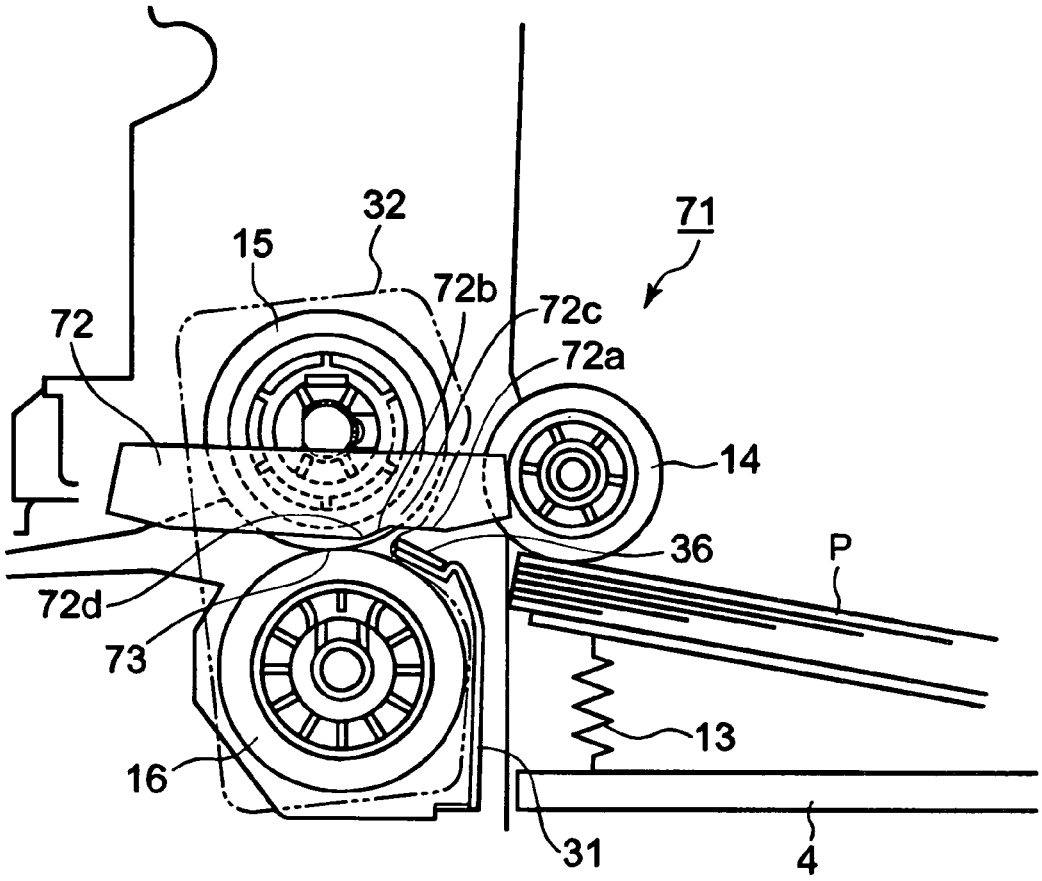
FIG. 7 is a schematic front view showing a sheet supply device according to a fourth embodiment of the present invention.

A fourth embodiment of the present invention will be explained next. FIG. 7 is a schematic front view showing a sheet supply device or a sheet supply unit 71 according to the fourth embodiment of the present invention.

As shown in FIG. 7, similar to the first to third embodiments, the sheet supply unit 71 includes the sheet supply roller 14, the first separation units 31, and the second separation unit 32 (indicated with a phantom line). The second separation unit 32 is formed of a pair of the transportation roller 15 and the separation roller 16 pressed against with each other. The first separation units 31 are disposed outside the extension area of the second separation unit 32 in the medium transportation direction.

In the fourth embodiment, different from the third embodiment, transportation guides 72 are provided above the first separation units 31. The transportation guides 72 have lower portions for guiding the medium P. More specifically, each of the lower portions has a first guide portion (a horizontal portion) 72*a* facing the friction members 36 of the first separation units 31 and extending in a horizontal direction; a second guide portion (an inclined portion) 72*b* for smoothly guiding the leading edge of the medium P toward a nip portion 72 of the second separation unit 32 on the downstream side of the first separation units 31 in the medium transportation direction; and a curved portion 72*c* formed between the first guide portion 72*a* and the second guide portion 72*b*.

In the embodiment, the curved portion 72*c* is situated on the downstream side of the first separation units 31 at a position on an outer circumference of the transportation roller 15 of the second separation unit 32 or slightly outside thereof. The transportation guides 72 have lower top portions 72*d* situated at a position slightly above the nip portion 73 of the second separation unit 32. More specifically, the curved portions 72*c* are situated outside the outer circumference of the transportation roller 15 by 0.2 mm, and the lower top portions 72*d* of the transportation guides 72 are situated above the nip portion 73 by 1.0 mm.

In the embodiment, when the sheet supply roller 14 supplies the medium P, the friction members 36 of the first separation units 31 separate the leading edge of the medium P. After the medium P passes through the first separation units 31, the first guide portions 72*a* of the transportation guides 72 guide the medium P. When the leading edge of the medium P reaches the curved portions 72*c*, a transportation load increases. Accordingly, when a plurality of the media P is transported, the curved portions 72*c* separate the leading edges of the media P.

After the medium P passes through the curved portions 72*c*, the second guide portions 72*b* of the transportation guides 72 guide the medium P toward the nip portion 72 of the second separation unit 32. Then, after the second separation unit 32 separates and supplies the medium P, an image is formed on the medium P through the process described above, and the medium P is discharged outside the electrophotography printer 1.

As described above, in the embodiment, the curved portions 72*c* of the transportation guides 72 are arranged to face the first separation units 31 on the downstream side thereof. When the medium P passes through the curved portions 72*c*, the transportation load increases, so that the curved portions 72*c* separate the leading edges of the media P. Accordingly, before the medium P reaches the second separation unit 32, the leading edge of the medium P is separated twice, thereby preventing the second separation unit 32 from transporting a plurality of the media P. As a result, it is possible to securely separate the media P with the second separation unit 32, thereby improving a separation capability of the sheet supply unit 71.

In the embodiment, the first guide portions 72*a* of the transportation guides 72 extend substantially in the horizontal direction, and may be inclined. The features in the fourth embodiment may be combined with the features in the second embodiment.

In the embodiments described above, the present invention is applied to the electro-photography printer as the image forming apparatus, and may be applicable to other device, for example, a copier, a facsimile, and a multifunction product having a sheet supply device for supplying a medium such as a cut sheet. The image forming unit 6 is not limited to the electro-photography method, and is applicable to other method such as an ink jet method. The present invention is further applicable to an original supply device of an image reading apparatus.

The disclosure of Japanese Patent Application No. 2007-248442, filed on Sep. 26, 2007, is incorporated in the application by reference.

While the invention has been explained with reference to the specific embodiments of the invention, the explanation is illustrative and the invention is limited only by the appended claims.

What is claimed is:

1. A sheet supply device comprising:

a medium storage portion for retaining a medium;

a medium feeding portion for feeding the medium from the medium storage portion;

a first separation unit for contacting with the medium at a first contact point;

a transportation guide arranged to face the first separation unit with a specific distance in between so that the medium passes through between the transportation guide and the first separation unit; and a second separation unit disposed on a downstream side of the first separation unit in a transportation direction of the medium for contacting with the medium at a second contact point after the medium passes through the first contact point of the first separation unit, said second separation unit being disposed substantially at a center in a width direction, said first separation unit being disposed outside the second separation unit, wherein said first separation unit includes a right side separation unit disposed on a right side of the second separation unit in the width direction and a left side separation unit disposed on a left side of the second separation unit in the width direction so that the second separation unit is not overlapped with the right side separation unit and the left side separation unit along the transportation direction, said transportation guide includes a right side guide facing the right side separation unit and a left side guide facing the left side separation unit, said right side separation unit and said left side separation unit are arranged to contact with a lower surface of the medium, wherein each of said right side guide and said left side guide includes a first rib facing the first separation unit and a second rib not facing the first separation unit, said right side guide and said left side guide are arranged to contact with an upper surface of the medium, said right side guide and said left side guide are arranged to extend from an upstream side of the first separation unit to a downstream side of the second separation unit in the transportation direction, said first separation unit further includes a separation member for separating the medium and a friction member for applying a load to the medium, said second separation unit includes a pair of rollers for separating the medium, and said friction member is arranged in an inclined state crossing from below to above an imaginary line between the second contact point and a third contact point where the medium feeding portion contacts with the medium.

2. The sheet supply device according to claim 1, wherein said rollers include a transportation roller and a separation roller pressed against the transportation roller at the second contact point, said first separation unit being disposed at a position above a straight line between the first contact point and the second contact point.

3. The sheet supply device according to claim 1, wherein said first separation unit includes a first inclined portion for abutting against the medium, said first inclined portion and the transportation guide forming a transportation path.

4. The sheet supply device according to claim 3, wherein said first inclined portion is arranged away from the transportation guide by a distance greater than a maximum thickness of the medium capable of being supplied and smaller than three times the maximum thickness.

5. The sheet supply device according to claim 3, wherein said rollers include a transportation roller and a separation roller pressed against with each other, said transportation guide including a second inclined portion inclined toward a contact point between the transportation roller and the separation roller.

6. An image forming apparatus comprising the sheet supply device according to claim 1 and an image forming unit for forming an image on the medium.

7. The sheet supply device according to claim 1, wherein said transportation guide extends from an upstream side of the second separation unit to a downstream side of the second separation unit so that the transportation guide guides the medium before and after the medium passes through the second separation unit.

8. The sheet supply device according to claim 7, wherein said transportation guide is disposed on both sides of the second separation unit.

9. The sheet supply device according to claim 7, wherein said transportation guide includes a rib portion protruding toward the first separation unit.

10. The sheet supply device according to claim 1, wherein said transportation guide is arranged to face the first separation unit in a direction perpendicular to the transportation direction.

11. The sheet supply device according to claim 1, wherein each of said right side guide and said left side guide includes a rib portion protruding toward the first separation unit.

12. The sheet supply device according to claim 1, wherein each of said right side guide and said left side guide includes a plurality of rib portions protruding toward the first separation unit.

13. The sheet supply device according to claim 1, wherein each of said right side guide and said left side guide includes a plurality of first rib portions facing the first separation unit and a second rib portion not facing the first separation unit.

14. The sheet supply device according to claim 1, wherein said first separation unit further includes a vertical portion extending upwardly from a lower portion of the medium storage portion, and an inclined portion extending obliquely and upwardly from the vertical portion.

15. The sheet supply device according to claim 14, wherein said right side guide and said left side guide are arranged to extend from the feeding portion toward the downstream side of the second separation unit so that a transportation path becomes narrower toward the downstream side of the second separation unit.

16. The sheet supply device according to claim 1, wherein said friction member is arranged in the inclined state so that one end portion of the friction member on an upstream side in the medium transportation direction is situated below the imaginary line and the other end portion of the friction member on a downstream side in the medium transportation direction is situated above the imaginary line.

17. The sheet supply device according to claim 1, wherein said transportation guide extends on an upstream side of the second point at a first direction and on a downstream side of the second point at a second direction different from the first direction.

18. A sheet supply device comprising:

a sheet supply member for supplying a medium;

a first separation unit for contacting with the medium at a first contact point;

a transportation guide arranged to face the first separation unit with a specific distance in between so that the medium passes through between the transportation guide and the first separation unit; and a second separation unit disposed on a downstream side of the first separation unit for contacting with the medium at a second contact point after the medium passes through the first contact point of the first separation unit, said second separation unit being disposed substantially at a center in a width direction, said first separation unit being disposed outside the second separation unit, wherein said first separation unit includes a right side separation unit disposed on a right side of the second separation unit in the width direction and a left side separation unit disposed on a left side of the second separation unit in the width direction, said transportation guide includes a right side guide facing the right side separation unit and a left side guide facing the left side separation unit, said first separation unit includes a first inclined portion for abutting against the medium, said first inclined portion and the transportation guide forming a transportation path, said second separation unit includes a transportation roller and a separation roller pressed against with each other, said transportation guide including a second inclined portion inclined toward a contact point between the transportation roller and the separation roller, and said transportation guide includes a horizontal portion facing the first inclined portion and extending substantially in a horizontal direction and a curved portion formed between the horizontal portion and the second inclined portion.

* * * * *